US009549606B1

(12) United States Patent
Casadesus

(10) Patent No.: US 9,549,606 B1
(45) Date of Patent: Jan. 24, 2017

(54) BELT-WEARABLE LAW ENFORCEMENT ACCESSORY CASE

(71) Applicant: Giddel Casadesus, Miami, FL (US)

(72) Inventor: Giddel Casadesus, Miami, FL (US)

( * ) Notice: Subject to any disclaimer, the term of this patent is extended or adjusted under 35 U.S.C. 154(b) by 0 days.

(21) Appl. No.: 14/741,370

(22) Filed: Jun. 16, 2015

Related U.S. Application Data

(60) Provisional application No. 62/012,679, filed on Jun. 16, 2014.

(51) Int. Cl.
*A45F 5/02* (2006.01)
*F41H 1/00* (2006.01)

(52) U.S. Cl.
CPC ..... *A45F 5/021* (2013.01); *F41H 1/00* (2013.01); *A45F 2200/0591* (2013.01)

(58) Field of Classification Search
CPC ..... A45F 5/021; A45F 2200/0591; F41H 1/00
USPC ..... 224/675, 684, 682
See application file for complete search history.

(56) References Cited

U.S. PATENT DOCUMENTS 2,850,152 A * 9/1958 Marrufo ..... A45C 11/04 206/234
5,040,711 A * 8/1991 Niederhauser ..... A01D 75/008 224/401
5,407,111 A * 4/1995 Lanouette ..... A45F 3/00 224/417
5,533,657 A * 7/1996 Rosen ..... A45F 5/02 224/191
D375,404 S * 11/1996 Moffitt ..... D3/228
5,586,707 A * 12/1996 Haskell ..... A63B 71/0672 224/242
7,658,307 B2 * 2/2010 Skupin ..... A45F 5/004 224/219
2002/0170933 A1 * 11/2002 Martin ..... A45F 5/02 224/197
2006/0169731 A1 * 8/2006 Matulewic ..... A45C 15/00 224/674
2008/0135588 A1 * 6/2008 Haines ..... A45F 5/02 224/148.1
2014/0361063 A1 * 12/2014 Reed ..... A45F 5/021 224/682

* cited by examiner

*Primary Examiner* — Corey Skurdal
(74) *Attorney, Agent, or Firm* — H. John Rizvi; Gold & Rizvi, P.A.

(57) ABSTRACT

A case for carrying accessories for law enforcement officers is presented, including a front panel and a back panel. The front panel and/or the back panel are constructed from a relatively flexible, stretchable, resilient material. One or more compartments are formed between the front panel and the back panel. For example, a first compartment is adapted and constructed to contain an ammunition magazine; a second compartment is adapted and constructed to contain a handcuffs key, a pen or another similarly elongated object; a third compartment is adapted and constructed to contain handcuffs. At least one selectively securable strap assembly is secured to the back panel, for securing the case to a belt of a wearer.

20 Claims, 6 Drawing Sheets

BELT-WEARABLE LAW ENFORCEMENT ACCESSORY CASE

CROSS-REFERENCE TO RELATED APPLICATION

This application claims the benefit of U.S. Provisional Patent Application Ser. No. 62/012,679, filed Jun. 16, 2014, which is incorporated herein in its entirety.

FIELD OF THE INVENTION

The present invention relates to a case for carrying accessories for law enforcement officers, and particularly to a flexible case that can be worn on a belt and is capable of retaining a spare ammunition magazine, a pair of handcuffs, and a handcuffs key or pen.

BACKGROUND OF THE INVENTION

Belt-worn cases for carrying firearms first came into use in the 1840's. As side arms gained wide usage with the opening up of the American West, the early pommel bag, carried on a saddle, gave way to an open-ended loop or sleeve fixed onto a wide belt. These loops provided ready access, but afforded no protection to the firearm. By the time of the Civil War, enclosed or semi-enclosed holsters were in common use to protect the workings of revolvers.

Today, military and law enforcement personnel use holsters constructed from a variety of material, and in myriad configurations. Furthermore, modern law enforcement methods require many tools in addition to the traditional side arm. Although it is not unusual for an officer to carry several items, three items are almost universally carried: a pair of handcuffs, a handcuffs key, and a spare ammunition magazine. These items are typically carried in a case or cases attached to the officer's belt.

Normally, cases known in the art for storing handcuffs, handcuff keys or magazines are bulky, rigid and heavy, in order to provide a secure and robust housing of such sensitive items. They usually facilitate carrying only one or two of the three essential items, requiring the user to wear more than one case. In consequence, law enforcement officers end up having to carry several bulky and heavy cases. While in service wearing a uniform, the fact of wearing heavy, bulky cases is not problematic as they are conveniently worn on the officer's uniform belt, protruding outwardly and unconcealed.

However, bulky cases known in the art are not easy to conceal beneath ordinary clothes. Thus, undercover agents, officers and investigators who work in plain clothes, and law enforcement officers who are off duty may have trouble carrying their equipment concealed beneath their clothes, compromising their personal safety and that of the people around them.

Accordingly, there remains a need in the art for an alternative case for carrying accessories for law enforcement officers, and particularly for a concealable case capable of safely retaining a spare ammunition magazine, a pair of handcuffs, and a handcuffs key. Such a case would be particularly advantageous for off-duty law enforcement officers who wish to comfortably carry their sensitive equipment at hand, yet hidden beneath their clothes.

SUMMARY OF THE INVENTION

The present invention overcomes the deficiencies of the known art and the problems that remain unsolved by providing a lightweight, belt-worn case capable of retaining a spare ammunition magazine, a pair of handcuffs, and a handcuffs key, a pen or a similarly elongated item. The belt-worn case includes a front panel and a back panel, at least one of which is made of a relatively flexible, stretchable, resilient material. The back panel and front panel are coupled forming three storage compartments configured to respectively store an ammunition magazine, a pair of handcuffs, and a handcuffs key, a pen or the like. The back panel and/or the front panel are elastically deformable and can be expanded to facilitate insertion of the magazine, handcuffs and handcuffs key, pen or the like; the back panel and/or front panel are resiliently deformable and return to a less expanded but partially tensioned state to provide a tight grip of the aforementioned items once they are inserted into their corresponding compartments. The case includes several strap assemblies for securing to a belt. The strap assemblies are attached to the back panel, preferably behind the magazine storage compartment and the handcuffs storage compartment, respectively arranged on each side of the handcuff key storage compartment.

Introducing a first embodiment of the invention, the present invention consists of a case for carrying accessories for law enforcement officers, the case comprising a front panel and a back panel, secured to one another forming a planar case body. The case further includes a set of three separate accessory storage compartments, formed between the front panel and the back panel and arranged successively along a longitudinal direction of the case body, wherein each compartment is delimited by the back panel and the front panel and has a respective top opening. At least one of the back panel and front panel is elastically stretchable in a lateral direction to adopt a stretched configuration for facilitating inserting and removing a respective accessory from each compartment, and a retracted configuration for snugly retaining the respective accessory in each compartment. The case further comprises at least one selectively securable transverse strap assembly connected to the back panel, the at least one selectively securable strap assembly configured to retain a belt in the longitudinal direction.

In a second aspect, the front panel and back panel can be secured to one another along a left edge and right edge of the case body, and the openings can be consecutively arranged along a top edge of the case body.

In another aspect, the front panel and back panel can be secured to one another along a left edge, right edge and bottom edge of the case body, and the openings can be consecutively arranged along a top edge of the case body.

In another aspect, only one of the back panel and the front panel may be elastically stretchable.

In another aspect, only the front panel may be stretchable.

In another aspect, both the back panel and the front panel may be elastically stretchable.

In another aspect, the at least one selectively securable strap assembly can include a plurality of securable strap assemblies arranged in a spaced-apart parallel configuration along the longitudinal direction.

In another aspect, the at least one selectively securable strap assembly can include a pair of securable strap assemblies arranged in a spaced-apart parallel configuration along the longitudinal direction.

In another aspect, the three separate accessory storage compartments can include a leftmost compartment, a central compartment and a rightmost compartment in accordance with a rear elevation view of the case presenting the back panel. One securable strap assembly of the pair of securable strap assembly can be arranged in lateral registration with the leftmost compartment, closer to a leftmost edge of the case body than to the central compartment. The other securable strap assembly of the pair of securable strap assembly can be arranged in lateral registration with the rightmost compartment, closer to a rightmost edge of the case body than to the central compartment.

In another aspect, each of the at least one selectively securable strap assemblies can include a strap portion and a connection mechanism.

In another aspect, the connection mechanism of the at least one selectively securable strap assembly can be provided as a selectively securable fastener.

In another aspect, the connection mechanism of the at least one selectively securable strap assembly can be provided as a hook-and-loop fastener.

In another aspect, the connection mechanism of the at least one selectively securable strap assembly can be provided as a snap fastener.

In another aspect, the connection mechanism of the at least one selectively securable strap assembly can include a magnet.

In yet another aspect, the case can be provided with a right-side configuration wherein a leftmost compartment is longer than a rightmost compartment, and wherein the leftmost and rightmost compartments are longer than a central compartment, the leftmost compartment, the central compartment and the rightmost compartment being defined as such in accordance with a rear elevation view of the case presenting the back panel.

In another aspect, the case can be provided with a left-side configuration wherein a rightmost compartment is longer than a leftmost compartment, and wherein the leftmost and rightmost compartments are longer than a central compartment, the leftmost compartment, the central compartment and the rightmost compartment being defined as such in accordance with a rear elevation view of the case presenting the back panel.

Introducing another embodiment of the invention, the present invention consists of a case for carrying accessories for law enforcement officers, the case comprising a front panel and a back panel, secured to one another forming a planar case body. The case further includes three separate accessory storage compartments, formed between the front panel and the back panel and arranged successively along a longitudinal direction of the case body. Each compartment is delimited by the back panel and the front panel and has a respective top opening. The set of three accessory storage compartments comprises a leftmost compartment, a central compartment and a rightmost compartment in accordance with a rear elevation view of the case presenting the back panel. At least one of the back panel and front panel is elastically stretchable in a lateral direction to adopt a stretched configuration for facilitating inserting and removing a respective accessory from each compartment, and a retracted configuration for snugly retaining the respective accessory in each compartment. The case further includes at least two selectively securable transverse strap assemblies connected to the back panel, the selectively securable strap assemblies configured to retain a belt in the longitudinal direction. One securable strap assembly of the at least two securable strap assemblies is arranged in lateral registration with the leftmost compartment and is closer to a leftmost edge of the case body than to the central compartment. Another securable strap assembly of the at two securable strap assemblies is arranged in lateral registration with the rightmost compartment and is closer to a rightmost edge of the case body than to the central compartment.

Introducing yet another embodiment of the invention, the present invention consists of a case for carrying accessories for law enforcement officers, the case comprising a front panel and a back panel, secured to one another forming a planar case body. The case further includes three separate accessory storage compartments, formed between the front panel and the back panel and arranged successively along a longitudinal direction of the case body. Each compartment is delimited by the back panel and the front panel and has a respective top opening. The set of three accessory storage compartments comprises a leftmost compartment, a central compartment and a rightmost compartment in accordance with a rear elevation view of the case presenting the back panel. A length of the leftmost compartment is different than a length of the rightmost compartment. The leftmost and rightmost compartments are longer than the central compartment. At least one of the back panel and front panel is elastically stretchable in a lateral direction to adopt a stretched configuration for facilitating inserting and removing a respective accessory from each compartment, and a retracted configuration for snugly retaining the respective accessory in each compartment. The case further includes at least two selectively securable transverse strap assemblies connected to the back panel, the selectively securable strap assemblies configured to retain a belt in the longitudinal direction. One securable strap assembly of the at least two securable strap assemblies is arranged in lateral registration with the leftmost compartment and is closer to a leftmost edge of the case body than to the central compartment. Another securable strap assembly of the at two securable strap assemblies is arranged in lateral registration with the rightmost compartment and is closer to a rightmost edge of the case body than to the central compartment.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

Figure 1:
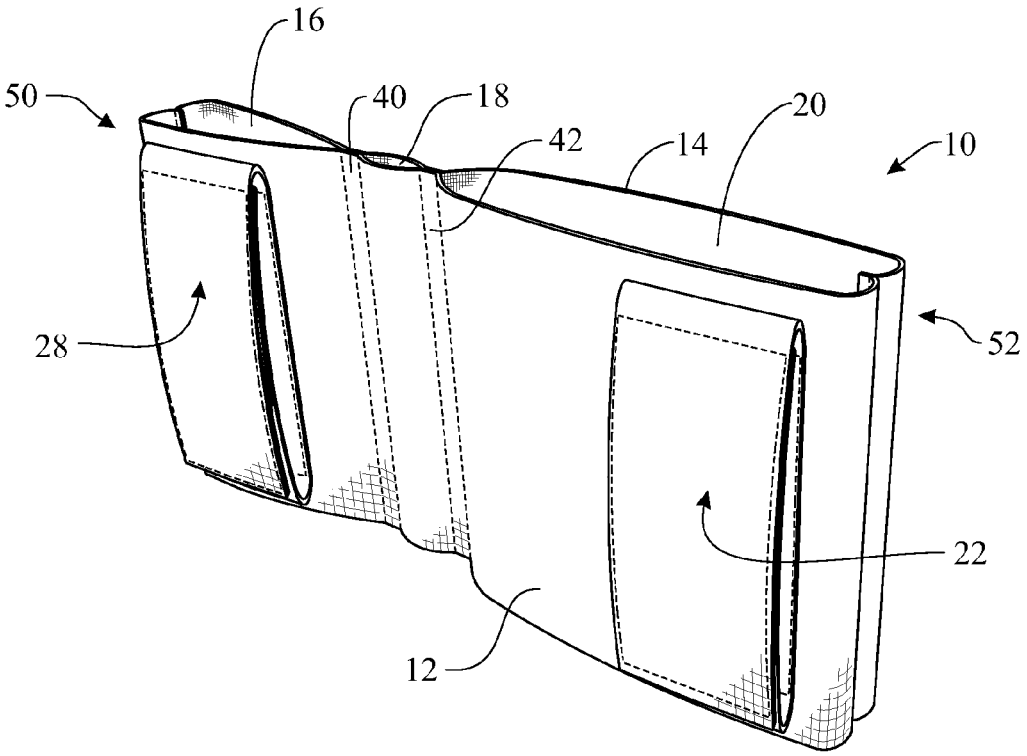
FIG. 1 presents a rear isometric view of a gun magazine, handcuffs and handcuffs key case, designed to be worn generally on the right side of the waste or right hip, in accordance with a first exemplary embodiment of the invention.
Figure 2:
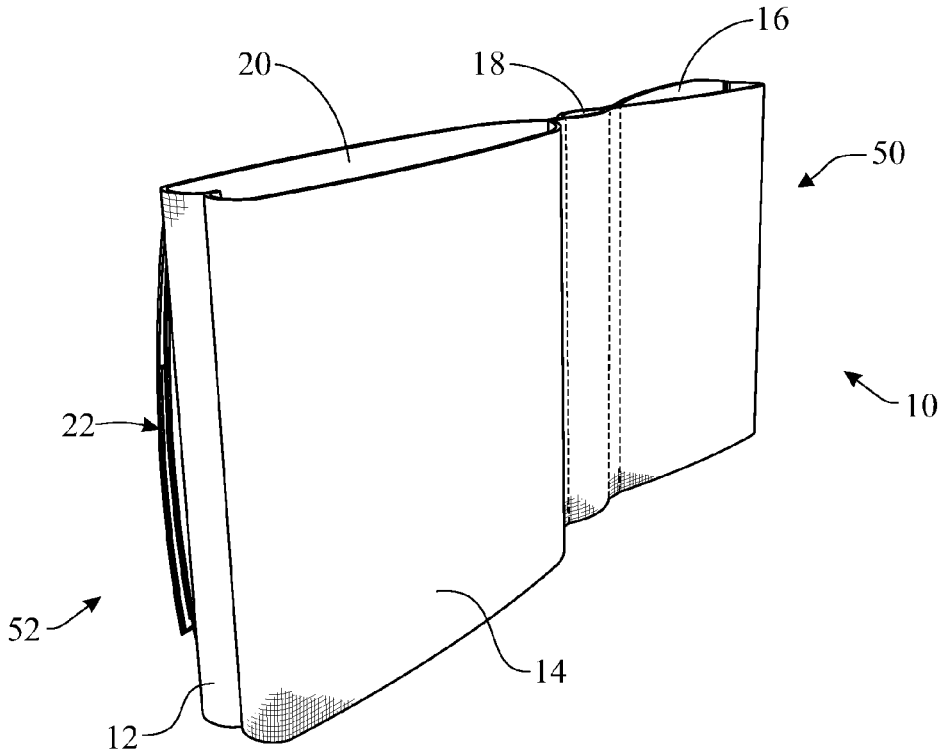
FIG. 2 presents a front isometric view of the case of FIG. 1.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

A case 10 for carrying accessories for law enforcement officers is presented in various configurations in the illustrations of FIGS. 1 through 5. The case 10 includes a back panel 12 and a front panel 14. The back panel 12 is constructed from a durable, relatively sturdy, and relatively non-flexible textile material (by "relatively" it is understood that the back panel 12 is sturdier and less flexible than the front panel 14). One example of a suitable material is a four inch webbing fabricated from polypropylene. In turn, the front panel 14 is constructed from a relatively flexible, stretchable, resilient material (by "relatively" it is understood that the front panel 14 is more flexible, stretchable and resilient than the back panel 12). One example of a suitable material is Spandex. The present embodiment further comprises three bottom pieces 15*a*, 15*b*, 15*c* arranged laterally to the back panel 12 and front panel 14.

Figure 3:
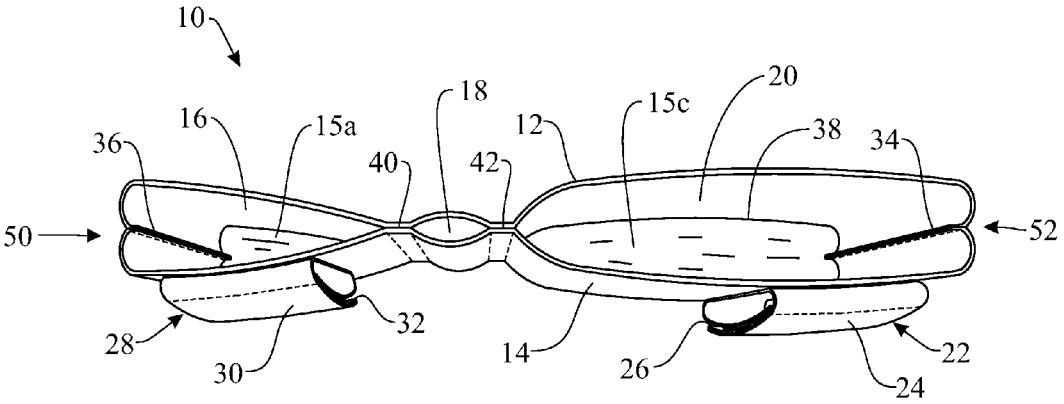
FIG. 3 presents a top isometric view of the case of FIG. 1.
Figure 4:
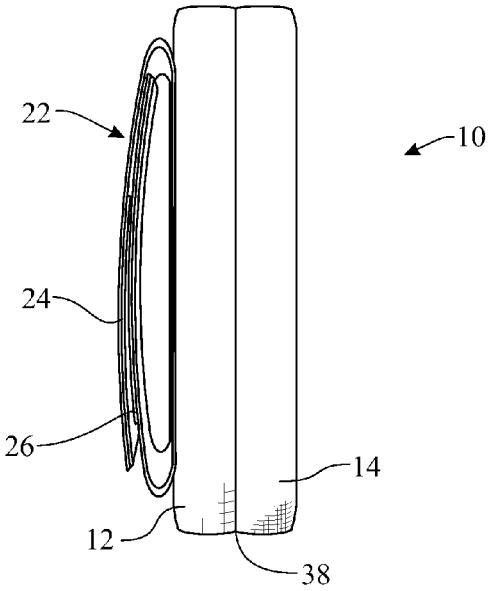
FIG. 4 presents a side isometric view of the case of FIG. 1.

As shown in the figures, and particularly in FIG. 3, the case 10 includes a first compartment 16, a second compartment 18, and a third compartment 20. Each of the compartments 16, 18, 20 is formed between the back panel 12, the front panel 14 and a corresponding bottom piece 15*a*, 15*b*, 15*c*. Alternative embodiments are contemplated in which one or more of the bottom pieces 15*a*, 15*b*, 15*c* are not present, and bottom edges of the back panel 12 and the front panel 14 are directly attached to each other to provide a bottom closure of the first, second and/or third compartments 16, 18, 20.

Figure 5:
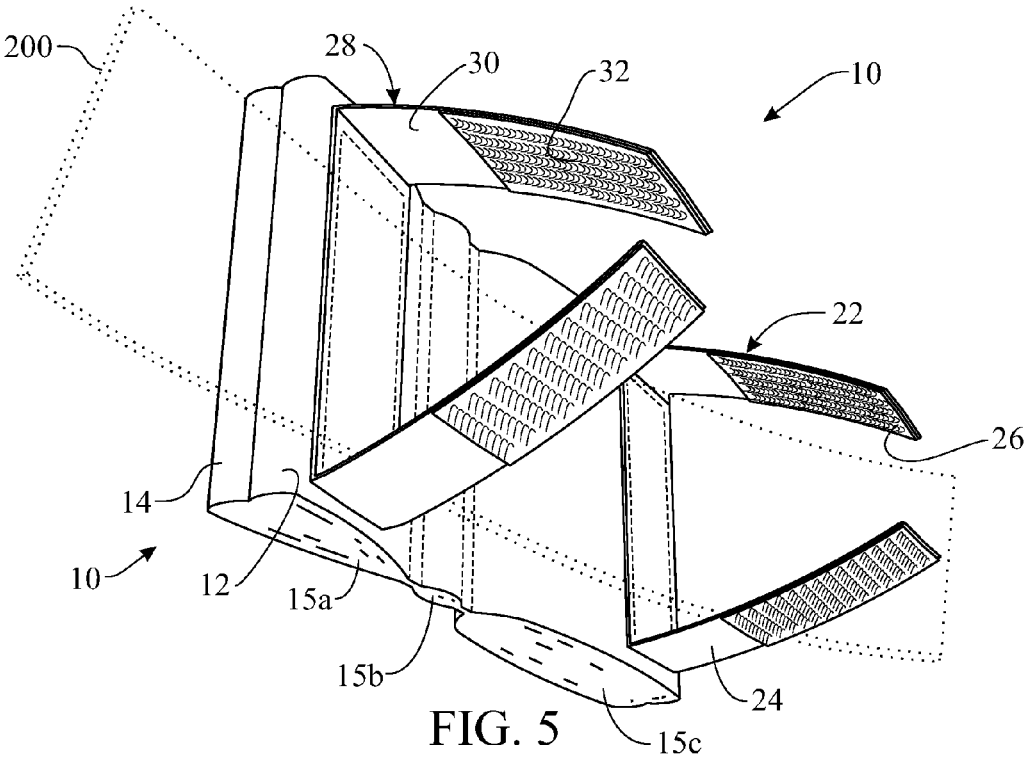
FIG. 5 presents a further rear isometric view of the case of FIG. 1, where the straps are unfastened and embracing a belt shown in dotted lines.

As shown in FIG. 1, a selectively securable first strap assembly 22 is connected to the back panel 12. The first strap assembly 22 includes a strap portion 24 and a connection mechanism 26, which are best shown in FIG. 5. In the present embodiment, the strap portion 24 is constructed from the same type of material as the back panel 12, i.e., from a durable, sturdy, and relatively non-flexible textile material such as polypropylene webbing. The connection mechanism 26 is provided as a selectively releasable securing mechanism, such as a hook-and-loop fastener (as shown), a snap fastener, a magnet-based fastener, or the like.

In turn, a selectively securable second strap assembly 28 is also connected to the back panel 12. The second strap assembly 28 includes a strap portion 30 and a connection mechanism 32. Similarly to the first strap assembly 22, the strap portion 30 is constructed from the same type of material as the back panel 12, i.e., from a durable, sturdy, and relatively non-flexible textile material such as polypropylene webbing. The connection mechanism 32 is provided as a selectively releasable securing mechanism, such as a hook-and-loop fastener (as shown), a snap fastener, a magnet-based fastener, or the like.

The case 10 can be constructed in any suitable manner. In one exemplary construction method, the back panel 12, the front panel 14 and the bottom pieces 15*a*, 15*b*, 15*c* are placed together inside-out, and sewn together along the side edges 34, 36 on each respective longitudinal end 50, 52 of the case 10, and along bottom edges 38. The assembled back panel 12 and front panel 14 are then turned right-side out, and a pair of spaced-apart, parallel seams 40, 42 are sewn to form the first, second and third compartments 16, 18, 20. Finally, the first strap assembly 22 and second strap assembly 28 are sewn onto the back panel 12. Although the connections between the various elements of the case 10 are described as being accomplished by sewing, it is contemplated that other connection methods can be employed, such as adhesives, heat welding, sonic welding, and the like.

Figure 6:
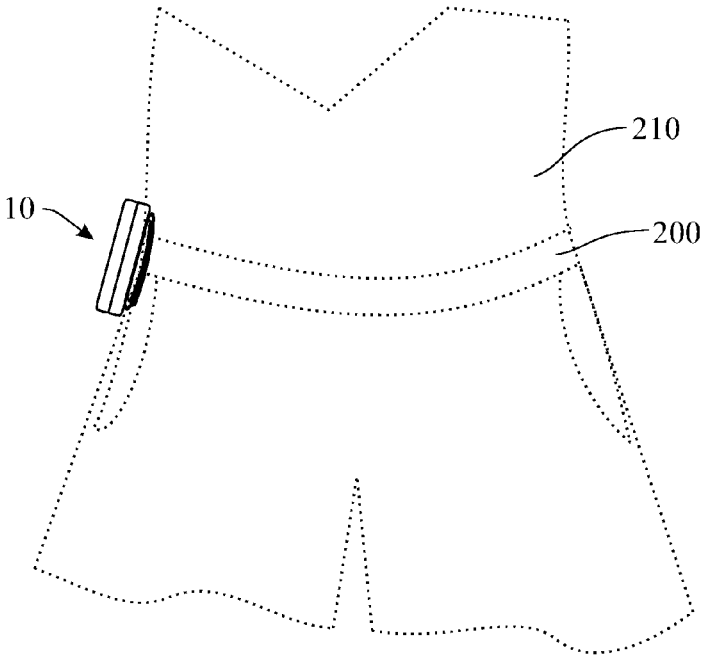
FIG. 6 presents a schematic view of the device of FIG. 1 being worn on a user's belt.

Attachment of the case 10 to a belt 200 of a wearer 210 is shown in FIGS. 5 and 6. The first strap assembly 22 and second strap assembly 28 are opened by causing the respective connection mechanisms 26, 32 to be released. The first strap assembly 22 and second strap assembly 28 are then placed around the belt 200 of the wearer 210, and the respective connection mechanisms 26, 32 are fastened. The wearer 210 is not required to take off the belt 200 in order to attach the case 10 to the belt 200. The use of quick-release mechanism such as hook-and-loop fasteners allows the wearer to quickly and easily attach or remove the case 10 in any situation.

Figure 7:
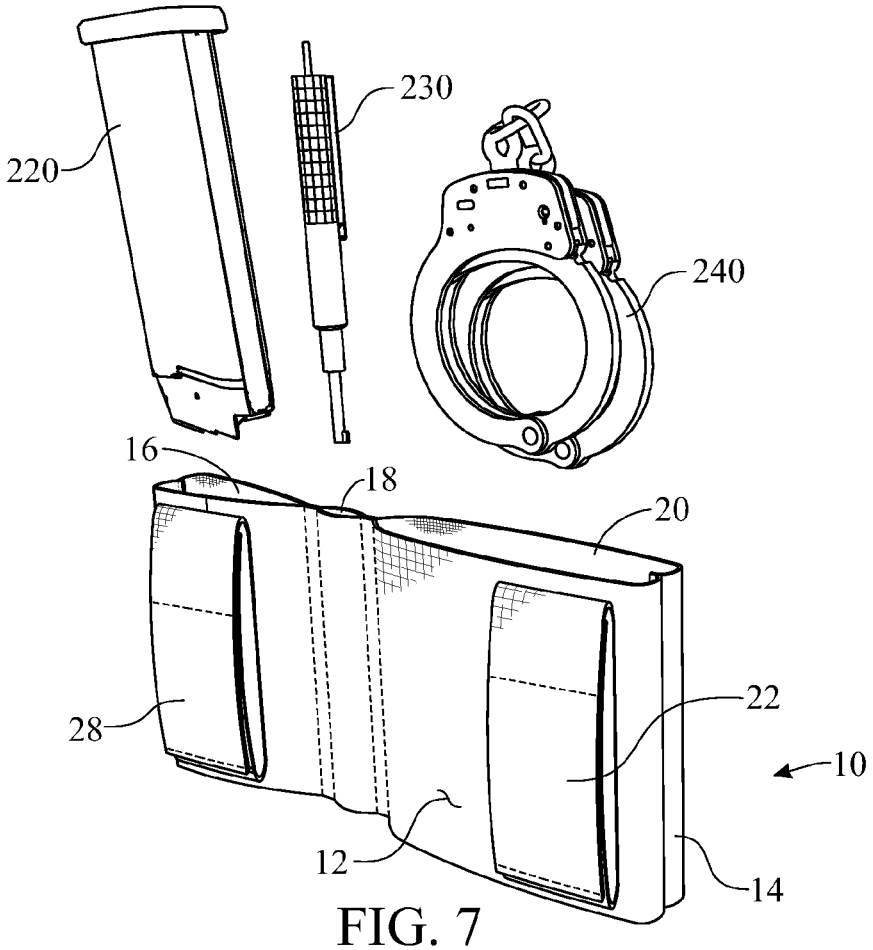
FIG. 7 presents an isometric rear view of the case of FIG. 1, an exemplary magazine, an exemplary pair of handcuffs and an exemplary handcuff key, prior to insertion of the three exemplary elements into the case.
Figure 8:
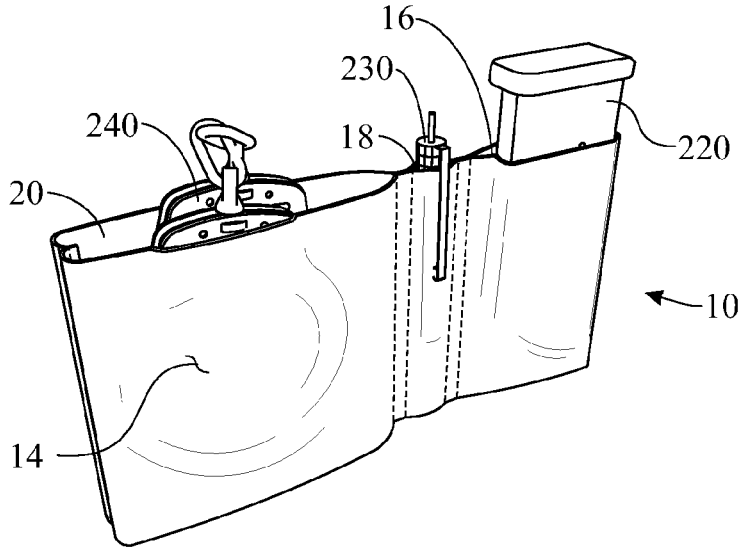
FIG. 8 presents a front isometric view of the case of FIG. 7, having inserted the three exemplary elements into the corresponding compartments.

Storage of articles in the case 10 is shown in FIGS. 7 and 8. The case 10 is adapted and constructed to hold a spare ammunition magazine 220, a handcuffs key 230, and a pair of handcuffs 240. As shown in FIGS. 7 and 8, the first compartment 16 retains the ammunition magazine 220 between the front panel 14 and the back panel 12. The second compartment 18 retains the handcuffs key 230 between the front panel 14 and the back panel 12. The third compartment 20 retains the handcuffs between the front panel 14 and the back panel 12. The flexibility of the front panel 14 of the case 10 allows the first, second and third compartments 16, 18, 20 to conform to almost any type of gun magazine, handcuff or handcuff key, providing a degree of versatility that is unattainable with known constructions. The second compartment 18 can also conveniently store a pen, pencil or other similarly elongated object. The combination of materials also facilitates quick release of the items while simultaneously holding the items securely, thus enhancing the safety of the user. Further, having a stretchable case is advantageous in that the case can be made small in size, lightweight and concealable. Having a stretchable front panel 14 directly attached to a back panel 12 greatly contributes to obtaining a non-bulky, concealable case 10. Such an advantage is maximized if no bottom pieces 15*a*, 15*b*, 15*c* are present.

The present invention is not only advantageous in that it helps carry sensitive items on a belt. When off duty, the male or female law enforcement officer can store the case 10 containing the magazine 210, handcuff key 230 and handcuffs 240 as shown in FIG. 8 in a backpack, bag, purse, suitcase or other applicable storage container. The magazine 210, handcuff key 230 and handcuffs 240 remain snugly fitted in the case 10 and can thus easily be located within, and quickly and jointly extracted from, the storage container.

The exemplary embodiment depicted in FIGS. 1 through 7 shows a "right-side" configuration of the case constructed in accordance with the principles of the present invention. In this embodiment, the case is designed to be worn on the user's right side, placing the ammunition magazine frontmost (for it to be more quickly reached and pulled out, thereby contributing to the wearer's personal safety), the handcuffs key in the middle, and the handcuffs toward the back of the wearer. Such a right-side-configured case will normally be used by a left-handed user, i.e., by a law enforcement officer who uses his/her left hand to operate a gun o handcuffs.

Figure 9:
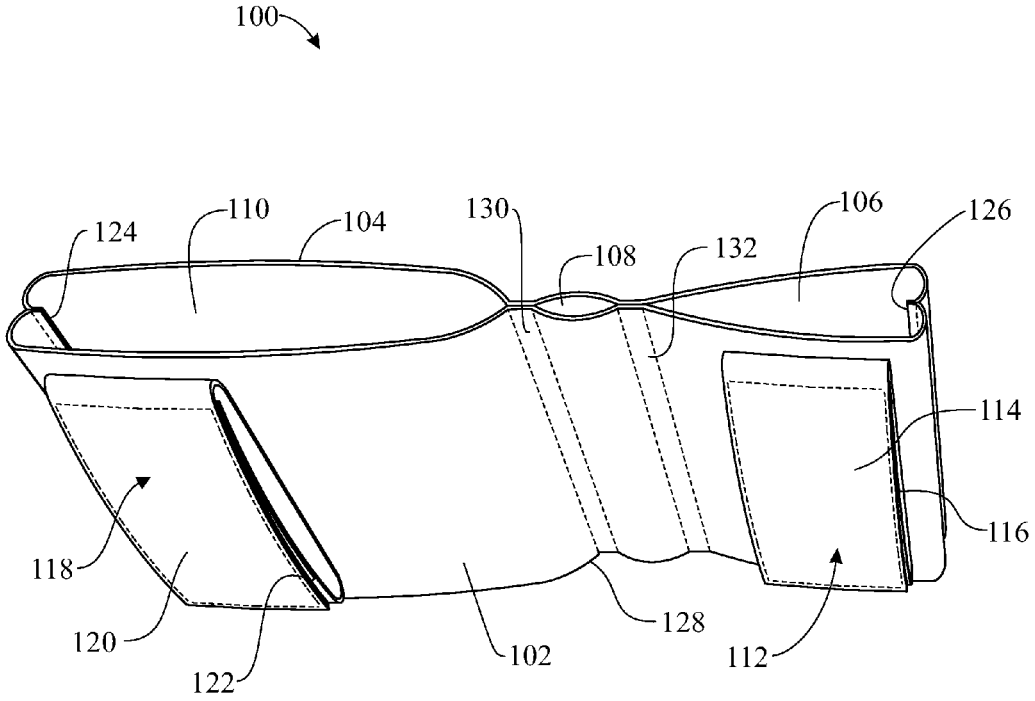
FIG. 9 presents a rear isometric view of a second embodiment of a gun magazine, handcuffs and handcuffs key case, designed to be worn generally on the left side of the waste or left hip.

It is also contemplated that the principles of the present invention are equally applicable to a "left-side" configuration. Such a left-side-configured case will normally be used by a right-handed user, i.e., by a law enforcement officer who uses his/her right hand to operate a gun o handcuffs. An exemplary left-hand user case 100 for carrying accessories for law enforcement officers is presented in FIG. 9. The case 100 includes a back panel 102 and a front panel 104. The back panel 102 is constructed from a durable, sturdy, and relatively non-flexible textile material. One example of a suitable material is a four inch webbing fabricated from polypropylene. The front panel 104 is constructed from a relatively flexible, stretchable, resilient material. One example of a suitable material is Spandex.

The case 100 includes a first compartment 106, a second compartment 108, and a third compartment 110. Each of the compartments 106, 108, 110 is formed between the back panel 102 and the front panel 104.

A selectively securable first strap assembly 112 is connected to the back panel 102. The first strap assembly 112 includes a strap portion 114 and a connection mechanism 116. The strap portion 114 is constructed from the same type of material as the back panel 102, a durable, sturdy, and relatively non-flexible textile material such as polypropylene webbing. The connection mechanism 116 is provided as a selectively releasable securing mechanism, such as a hook-and-loop fastener (as shown), a snap fastener, a magnet-based fastener, or the like.

A selectively securable second strap assembly 118 is connected to the back panel 102. The second strap assembly 118 includes a strap portion 120 and a connection mechanism 122. The strap portion 120 is constructed from the same type of material as the back panel 102, i.e., a durable, sturdy, and relatively non-flexible textile material such as polypropylene webbing. The connection mechanism 122 is provided as a selectively releasable securing mechanism, such as a hook-and-loop fastener (as shown), a snap fastener, a magnet-based fastener, or the like.

The case 100 can be constructed in any suitable manner. In the exemplary construction shown in the figure, the first strap portion 114 and second strap portion 120 are sewn onto the back panel 102. Next, the back panel 102 and front panel 104 are placed together inside-out, and sewn together along the side edges 124, 126 and bottom 128. The assembled back panel 102 and front panel 104 are then turned right-side out, and a pair of spaced-apart, parallel seams 130, 132 are sewn to form the first, second and third compartments 106, 108, 110. Although the connections between the various elements of the case 100 are described as being accomplished by sewing, it is contemplated that other connection methods can be employed, such as adhesives, heat welding, sonic welding, and the like.

Connection of the case 100 to the belt of a wearer is identical to that described with reference to the case 10, as is the insertion and retention of ammunition magazine, handcuffs key, and handcuffs. The case 100 is a mirror image of the case 10, in that when the case 100 is intended to be worn on the left side of the user, placing the ammunition magazine frontmost, the handcuffs key in the middle, and the handcuffs toward the back of the wearer's left side.

Figure 10:
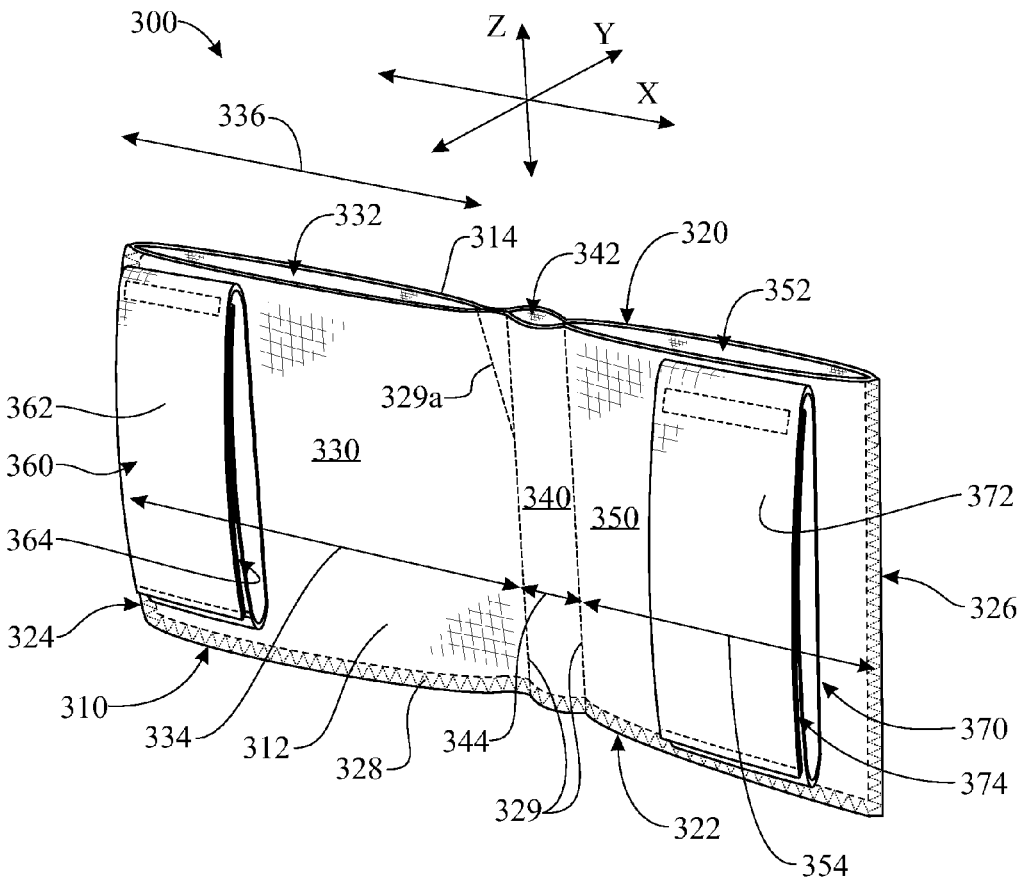
FIG. 10 presents a rear isometric view of a gun magazine, handcuffs and handcuffs key case, designed to be worn generally on the right side of the waste or right hip, in accordance with a second exemplary embodiment of the invention.

The illustration of FIG. 10 presents a top rear perspective view of a case 300 for carrying accessories for law enforcement officers in accordance with a third exemplary embodiment of the invention. Similarly to the previous embodiments, the case 300 of the present embodiment comprises a generally planar case body 310 arranged along a longitudinal direction X and including a back panel 312 and a front panel 314 that are secured to one another. The case body 310 comprises a top edge 320, a bottom edge 322, a left edge 324 and a right edge 326, in accordance with a rear elevation view of the case 300 presenting the back panel 312.

Three separate accessory storage pockets or compartments are formed between the front panel 314 and the back panel 312. Specifically, in accordance with a rear view such as that of FIG. 10 and similarly to the previous embodiments, the case 300 includes a first or leftmost compartment 330, a second or central compartment 340 and a third or rightmost compartment 350. The compartments 330, 340 and 350 and arranged successively along the longitudinal direction X of the case body 310, each compartment 330, 340, 350 being delimited by the back panel 312 and the front panel 314 and having a respective top opening 332, 342, 352. Both the back panel 312 and the front panel 314 of the present embodiment are elastically stretchable in a lateral direction Y to adopt a stretched configuration for facilitating inserting and removing a respective accessory from each compartment 330, 340, 350, and a retracted configuration for snugly retaining said respective accessory in each compartment 330, 340, 350. Thus, in order to insert the accessories (such as a pair of handcuffs 240, a handcuff key 230 and a magazine 220 as shown in FIG. 7 with reference to a previous embodiment) when wearing the case 300 on a belt, the user can intuitively and rapidly push the accessories into the openings, causing the compartments to stretch, and further push the accessories until they are housed and elastically retained within the compartments. In addition, while wearing the case 300 on a belt, a user can rapidly and easily retrieve his or her equipment by simply pulling it out vertically upwards from the individual compartments 330, 340, 350, as the panels 312, 314 stretch responsively to pulling of the equipment.

Similarly to the previous embodiments, the front panel 314 and back panel 312 are secured to one another along the left edge 324 and right edge 326 of the case body 310, and the openings 332, 342, 352 are consecutively arranged along the top edge 320 of the case body 310. In addition, unlike the previous embodiments, the front panel 314 and back panel 312 of the present embodiment are also secured to one another along the bottom edge 322 of the case body 310. In other words, the case body 310 of the present embodiment is formed by affixing two parallel panels along a bottom edge 322, left edge 324 and right edge 326, such as by an edge stitching 328 along the edges 322, 324, 326. Intermediate seams 329 separate the compartments 330, 340, 350. The intermediate seams 329 can be arranged, preferably, in a transverse direction Z perpendicular to the longitudinal direction X and the lateral direction Y, as shown in the figure. The present embodiment is not only effective and concealable, but also may be manufactured at reasonable cost as the number and shape of the components involved in manufacturing the case 300 is minimal.

The case 300 further includes at least one selectively securable transverse strap assembly, and more particularly a first strap assembly 360 and a second strap assembly 370. The first strap assembly 360 comprises a strap portion 362 and a connection mechanism 364. In turn, the second strap assembly 370 comprises a strap portion 372 and a connection mechanism 374. The connection mechanisms 364, 374 can be selectively securable fasteners, i.e. disconnectably connectable fasteners that can be disconnected and connected repeatedly; for instance and without limitation, the connection mechanism can include a hook-and-loop fastener, a snap fastener, or a magnet.

The first and second strap assemblies 360, 370 are connected to the back panel 312 and are configured to retain a belt that were to be arranged in the longitudinal direction X and embraced by the first and second strap assemblies 360, 370 (similarly to the arrangement of belt 200 shown in FIG. 5 with reference to the first embodiment). The selectively securable strap assemblies 360, 370 are arranged in a spaced-apart configuration along the longitudinal direction X, and are parallel to one another.

As shown in FIG. 10, similarly to the previous embodiments, the first securable strap assembly 360 is arranged in transverse registration with the leftmost compartment 330 and is closer to the left edge 324 of the case body 310 than to the central compartment 340. In turn, the second securable strap assembly 370 is arranged in transverse registration with the rightmost compartment 350 and is closer to the right edge 326 of the case body 326 than to the central compartment 340. Such outwardly arranged first and second securable strap assemblies 360, 370 provide a very stable and secure attachment to the belt, minimizing oscillation of the case 300 on the belt and reducing the risk of the case 300 being torn off the belt by pulling on one longitudinal end of the case 300.

Similarly to the previous embodiments, the case 300 of the present embodiment is particularly intended for storing a pair of handcuffs 240, a handcuff key 230 (or other similarly elongated object) and a magazine 220 such as, without limitation, those depicted in FIG. 7. For this purpose, the length 334 of the leftmost compartment 330 is greater than the length 344 of the central compartment 340 and is also greater than the length 354 of the rightmost compartment 350 (length being understood to be a dimension measured along the longitudinal axis X); the leftmost compartment 330 is particularly intended for storing a pair of handcuffs 240. In order to contribute to retaining the pair of handcuffs 240, an oblique seam 329*a* is provided in a top area of the leftmost compartment 330, extending from an intermediate point of an intermediate seam 329 arranged between the leftmost compartment 330 and the central compartment 340, and an intermediate point of the top edge 320 of the case body 310 arranged between the central compartment opening 342 and the left edge 324 of the case body 310. Due to the presence of the oblique seam 329*a*, the length 336 of the opening 332 of the leftmost compartment 330 is less than the maximum length 334 of the leftmost compartment 330, and thus a generally circular pair of handcuffs can be retained by such a narrowed opening 332.

The case 300 of FIG. 10 is particularly advantageous for a right-handed user, as it can be worn on a left side of the body with the magazine (stored in the rightmost compartment 350) arranged frontward relative to the central and leftmost compartments 340, 330. An alternative, right-side embodiment is contemplated, however, in which the rightmost compartment 350 is longer than the leftmost compartment 330, and in which the leftmost and rightmost compartments 330, 350 are longer than the central compartment 340. This right-side embodiment is particularly advantageous for left-handed users, as it provides adequate forward storage of the magazine when worn on the right side of the user's body.

Alternative embodiments are contemplated in which the case can include additional storage compartments or pockets without departing from the scope of the invention. Preferably, the additional compartments or pockets are also arranged or aligned along the longitudinal direction of the case, and along the belt of the user.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A case for carrying accessories for law enforcement officers, the case comprising:

a front panel and a back panel, secured to one another forming a planar case body;

seams forming three separate accessory storage compartments, formed between the front panel and the back panel and arranged successively along a longitudinal direction of the case body, each compartment being delimited by the back panel and the front panel and having a respective top opening, wherein at least one of said back panel and front panel is elastically stretchable in a lateral direction to adopt a stretched configuration for facilitating inserting and removing a respective accessory from each compartment, and a retracted configuration for snugly retaining said respective accessory in each compartment;

an oblique seam extending from an intermediate point of one of the seams and an intermediate point of a top edge of the case body wherein due to a presence of the oblique seam a length of a respective top opening is less than a maximum length of a respective compartment to contribute in retaining a pair of handcuffs; and at least one selectively securable transverse strap assembly connected to the back panel, the at least one selectively securable strap assembly configured to retain a belt in said longitudinal direction.

2. The case of claim 1, wherein the front panel and back panel are secured to one another along a left edge and right edge of the case body, said openings being consecutively arranged along a top edge of said case body.

3. The case of claim 1, wherein the front panel and back panel are secured to one another along at least a left edge and a right edge of the case body, said openings being consecutively arranged along a top edge of said case body, wherein the case body is constructed by placing the back panel and the front panel inside out, sewing the back panel and the front panel along the left and right edges, sewing along a bottom edge of the case body to provide a bottom closure, turning the back panel and the front panel right side out, and sewing the seams to form the compartments.

4. The case of claim 1, wherein only one of the back panel and the front panel is elastically stretchable.

5. The case of claim 4, wherein only the front panel is stretchable.

6. The case of claim 1, wherein both the back panel and the front panel are elastically stretchable.

7. The case of claim 1, wherein the at least one selectively securable strap assembly comprises a plurality of securable strap assemblies arranged in a spaced-apart parallel configuration along said longitudinal direction.

8. The case of claim 1, wherein the at least one selectively securable strap assembly comprises a pair of securable strap assemblies arranged in a spaced-apart parallel configuration along said longitudinal direction.

9. The case of claim 8, wherein said three separate accessory storage compartments comprise a leftmost compartment, a central compartment and a rightmost compartment in accordance with a rear elevation view of said case presenting the back panel, wherein one securable strap assembly of said pair of securable strap assemblies is arranged in lateral registration with said leftmost compartment and is closer to a leftmost edge of the case body than to said central compartment, and wherein the other securable strap assembly of said pair of securable strap assemblies is arranged in lateral registration with said rightmost compartment and is closer to a rightmost edge of said case body than to said central compartment.

10. The case of claim 1, wherein each of the at least one selectively securable strap assemblies includes a strap portion and a connection mechanism.

11. The case of claim 10, wherein the connection mechanism of the at least one selectively securable strap assembly is provided as a selectively securable fastener.

12. The case of claim 11, wherein the connection mechanism of the at least one selectively securable strap assembly is provided as a hook-and-loop fastener.

13. The case of claim 11, wherein the connection mechanism of the at least one selectively securable strap assembly is provided as a snap fastener.

14. The case of claim 11, wherein the connection mechanism of the at least one selectively securable strap assembly comprises a magnet.

15. The case of claim 1, wherein said three accessory storage compartments comprise a leftmost compartment, a central compartment and a rightmost compartment in accordance with a rear elevation view of said case presenting the back panel, wherein the case is provided with a left-side configuration wherein said leftmost compartment is longer than said rightmost compartment and wherein said leftmost and rightmost compartments are longer than said central compartment.

16. The case of claim 1, wherein said three accessory storage compartments comprise a leftmost compartment, a central compartment and a rightmost compartment in accordance with a rear elevation view of said case presenting the back panel, wherein the case is provided with a right-side configuration wherein said rightmost compartment is longer than said leftmost compartment, and wherein said leftmost and rightmost compartments are longer than said central compartment.

17. A case for carrying accessories for law enforcement officers, the case comprising:

a front panel and a back panel, secured to one another forming a planar case body;

seams forming three separate accessory storage compartments, formed between the front panel and the back panel and arranged successively along a longitudinal direction of the case body, each compartment being delimited by the back panel and the front panel and having a respective top opening, wherein said three accessory storage compartments comprise a leftmost compartment, a central compartment and a rightmost compartment in accordance with a rear elevation view of said case presenting the back panel, wherein at least one of said back panel and front panel is elastically stretchable in a lateral direction to adopt a stretched configuration for facilitating inserting and removing a respective accessory from each compartment, and a retracted configuration for snugly retaining said respective accessory in each compartment;

an oblique seam extending from an intermediate point of one of the seams and an intermediate point of a top edge of the case body, wherein due to a presence of the oblique seam, a length of a respective top opening is less than a maximum length of a respective compartment to contribute in retaining a pair of handcuffs; and at least two selectively securable transverse strap assemblies connected to the back panel, the selectively securable strap assemblies configured to retain a belt in said longitudinal direction, wherein one securable strap assembly of said at least two securable strap assemblies is arranged in lateral registration with said leftmost compartment and is closer to a leftmost edge of said case body than to said central compartment, and wherein another securable strap assembly of said at two securable strap assemblies is arranged in lateral registration with said rightmost compartment and is closer to a rightmost edge of said case body than to said central compartment.

18. A case for carrying accessories for law enforcement officers, the case comprising:

a front panel and a back panel, secured to one another forming a planar case body;

seams forming three separate accessory storage compartments, formed between the front panel and the back panel and arranged successively along a longitudinal direction of the case body, each compartment being delimited by the back panel and the front panel and having a respective top opening, wherein said three accessory storage compartments comprise a leftmost compartment, a central compartment and a rightmost compartment in accordance with a rear elevation view of said case presenting the back panel, wherein a length of said leftmost compartment is different than a length of said rightmost compartment, and wherein said leftmost and rightmost compartments are longer than said central compartment, wherein at least one of said back panel and front panel is elastically stretchable in a lateral direction to adopt a stretched configuration for facilitating inserting and removing a respective accessory from each compartment, and a retracted configuration for snugly retaining said respective accessory in each compartment;

an oblique seam extending from an intermediate point of one of the seams and an intermediate point of a top edge of the case body, wherein due to a presence of the oblique seam, a length of a respective top opening is less than a maximum length of a respective compartment to contribute in retaining a air of handcuffs; and at least two selectively securable transverse strap assemblies connected to the back panel, the selectively securable strap assemblies configured to retain a belt in said longitudinal direction, wherein one securable strap assembly of said at least two securable strap assemblies is arranged in lateral registration with said leftmost compartment and is closer to a leftmost edge of said case body than to said central compartment, and wherein another securable strap assembly of said at two securable strap assemblies is arranged in lateral registration with said rightmost compartment and is closer to a rightmost edge of said case body than to said central compartment.

19. The case of claim 18, wherein said leftmost compartment is longer than said rightmost compartment.

20. The case of claim 18, wherein said rightmost compartment is longer than said leftmost compartment.

* * * * *